US005816526A

United States Patent [19]

Bartelmuss et al.

[11] Patent Number: 5,816,526

[45] Date of Patent: Oct. 6, 1998

[54] TEAR STRIP FOR SEVERING A MOVING PAPER WEB

[76] Inventors: Klaus Bartelmuss; Heinz Bartelmuss, both of Teufenbach Nr. 63, A-8833 Teufenbach, Austria

[21] Appl. No.: 601,714

[22] Filed: Feb. 15, 1996

[30] Foreign Application Priority Data

Feb. 15, 1995 [AT] Austria ..... 276/95

[51] Int. Cl.[6] ..... B65H 35/08

[52] U.S. Cl. ..... 242/526.2; 225/91; 428/126; 428/130; 428/182

[58] Field of Search ..... 225/91; 428/124, 428/126, 130, 182; 242/526.2

[56] References Cited

U.S. PATENT DOCUMENTS

| | | | |
|---|---|---|---|
| 472,079 | 4/1892 | Ross | 428/126 |
| 1,320,692 | 11/1919 | Hulse | 428/126 |
| 1,831,764 | 11/1931 | Evans | 428/126 X |
| 2,197,181 | 4/1940 | Katz | 428/126 X |
| 3,972,768 | 8/1976 | Hill | 428/130 X |
| 4,018,959 | 4/1977 | Demko et al. . | |
| 4,041,201 | 8/1977 | Wurker | 428/124 X |
| 4,711,404 | 12/1987 | Falk . | |
| 4,925,718 | 5/1990 | Tsujimoto et al. | 428/124 X |
| 5,023,395 | 6/1991 | O'Connor | 428/124 X |
| 5,246,762 | 9/1993 | Nakamura | 428/182 X |
| 5,418,027 | 5/1995 | Conboy | 428/182 X |
| 5,472,540 | 12/1995 | Marschke et al. | 156/184 |

FOREIGN PATENT DOCUMENTS

| | | | |
|---|---|---|---|
| 413118 | 2/1991 | European Pat. Off. | 428/124 |
| 511108 | 12/1920 | France | 428/126 |
| 722902 | 3/1932 | France | 428/126 |
| 1142395 | 1/1963 | Germany | 428/124 |

*Primary Examiner*—Donald P. Walsh
*Assistant Examiner*—William A. Rivera
*Attorney, Agent, or Firm*—Herbert L. Lerner; Laurence A. Greenberg; Werner H. Stemer

[57] ABSTRACT

A tear strip severs a moving paper web as it is being wound onto a drum, so as to enable the paper web to be wound onto an empty drum. The tear strip is made of paper. The tear strip is a multiply folded paper strip, and the plies of the paper strip resting on one another are at least partially adhesively bonded to one another.

15 Claims, 3 Drawing Sheets

TEAR STRIP FOR SEVERING A MOVING PAPER WEB

BACKGROUND OF THE INVENTION

Field of the Invention

The invention relates to paper production, and more particularly to a device for severing a moving web of paper with a tear strip, whereby the paper web is wound onto a drum and, upon severing with the tear strip, it is wound onto an empty drum. The tear strip is a tear strip made of paper.

Webs of paper, made in a paper mill system, are wound up onto cores. When the paper roll reaches a predetermined package diameter the paper web, which is moving at a speed of about 25 meters per second, must be severed. The following web can then be wound onto an empty coil. A tear strip is used for severing the web. The tear strip winds itself spirally on the empty core, and at the same time the web of paper is severed along a spiral line. To enable recycling of the tear strip together with the portions of the paper web that have been damaged in the severing operation, it is known to make the tear strip out of paper.

Such a tear strip, which must have high tensile strength and high rigidity, has been made heretofore from a number of paper strings located side by side and glued together. To accomplish the gluing operation, the paper strings are wetted with a water-soluble adhesive over their entire surface. Since they are then pressed together as they rest against one another, they stick to one another at the contacting surfaces. After the adhesive is dry, the thus-made tear strip is wound up onto a roll.

Prior art tear strips of this kind have a number of disadvantages:

When the strings are made they are wetted with adhesive over their entire circumference. The tear strip wound up onto a core can therefore stick under the influence of moisture. Also under the influence of moisture, the glued-together paper strings can come loose from one another, thus lessening the strength of the tear strip. Moreover, the separated individual strings may possibly cause problems when the tear strip is used.

Another disadvantage of the prior art tear strip is that the individual paper strings from which it is made must have a minimum diameter. The tear strip thus has a minimum thickness which, when the strip is used to sever paper webs and the weight of the paper is relatively low, can cause deleterious effects and the paper web is damaged. The need also exists for manufacturing such a tear strip with exact tolerances, to preclude attendant problems in its movement through a feed channel. This need can be met only with difficulty in the case of a tear strip made from a plurality of strings, however, since the strings cannot be made in exact sizes.

Moreover, when the tear strip is cut apart, the individual strings are severed at different points along the length of the tear strip, which can likewise cause functional problems. In addition, it is quite difficult to unravel tear strips made from twisted strings in the recycling process.

Finally, surface layers of adhesive, which are applied to the tear strips (for the purpose of securing the tear strip to the empty core and to enable initiating the paper web severing process at a later point), stick to a tear strip made of paper strings only along the jacket lines on the outside of the paper strings. This means that the layers of adhesive can come off the tear strip.

SUMMARY OF THE INVENTION

It is accordingly an object of the invention to provide a tear strip for severing a moving paper web, which overcomes the above-mentioned disadvantages of the heretofore-known devices and methods of this general type, and which overcomes the particular disadvantages associated with the tear strip made from individual strings.

With the foregoing and other objects in view there is provided, in accordance with the invention, a tear strip assembly for severing a moving paper web being wound onto a drum, for enabling the paper web to be wound onto an empty drum, comprising: a tear strip formed of a multiply folded paper strip, said paper strip defining a plurality of plies resting on one another, said plies being at least partially adhesively bonded to one another.

Several further embodiments of the general principle are disclosed and claimed. For instance, the paper strip has two lateral regions, and the lateral regions are folded over multiple times; or the two lateral regions are folded over onto one side; or the two lateral regions of the paper strip are folded over onto mutually different sides.

In accordance with an added feature of the invention, the paper strip has two side edges, and the two side edges of the paper strip are located approximately centrally in the tear strip; or the two lateral regions of the paper strip are folded over onto one side, overlapping one another; or the two side edges of the paper strip are located approximately at respective side edges of the tear strip.

In accordance with an additional feature of the invention, there is provided an inlay paper strip disposed between at least two of the plies, and the inlay paper strip is adhesively bonded to the paper strip. The inlay paper strip is a multi-ply paper strip or it is a folded paper strip. The inlay may be gummed on both flat sides thereof or it may be a backingless adhesive strip.

In accordance with several further features of the invention, the paper strip is made of paper material having a primarily longitudinal fiber orientation parallel to a longitudinal extent of the tear strip; the adhesive is water-soluble; the tear strip is formed with longitudinally extending grooves; and/or the tear strip is corrugated in a transverse direction thereof. This makes the tear strip flexible in the crosswise direction and or in the longitudinal direction.

In other words, the objects of the invention are solved in that the tear strip is formed by at least one multiply folded paper strip, and the plies of the paper strip resting on one another are partially or fully adhesively bonded to one another.

The novel tear strip overcomes all the disadvantages of the prior art tear strip:

By the choice of paper thicknesses and the number of plies of paper, it can be made with any tensile strength and stiffness, thus enabling accurate adaptation to the thickness or quality of the paper of the paper web that is to be severed. Since there is no adhesive on the outside of the tear strip, no sticking together of the wound-up tear strip can occur. Since instead the adhesive is located only inside the tear strip, undoing of the adhesive bond by moisture, which lowers the tensile strength of the tear strip, is also averted.

A tear strip made from multi-ply paper strips glued together with a water-soluble adhesive are also more easily unraveled in the recycling process, and is therefore more readily recycled. In addition, such a tear strip when severed is severed along a virtually straight edge, so that no paper remnants that can cause functional problems in the feed channel are left behind. Since moreover such a tear strip has longitudinal edges which, while they extend in a straight line, are not sharp, an optimal course in the process of severing the paper web is thereby assured. Since furthermore such a tear strip has a virtually smooth surface, generally flat layers of adhesive adhere well enough to it that they cannot come loose. Finally, such a tear strip can be made in unlimited lengths.

In exemplary terms, a tear strip according to the invention is formed of a paper strip that is folded multiple times; the plies resting on one another are glued together with a water-soluble adhesive. The adhesive is located inside the tear strip, and the outsides of the tear strip are kept free of adhesive.

Other features which are considered as characteristic for the invention are set forth in the appended claims.

Although the invention is illustrated and described herein as embodied in a tear strip for severing a moving paper web, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
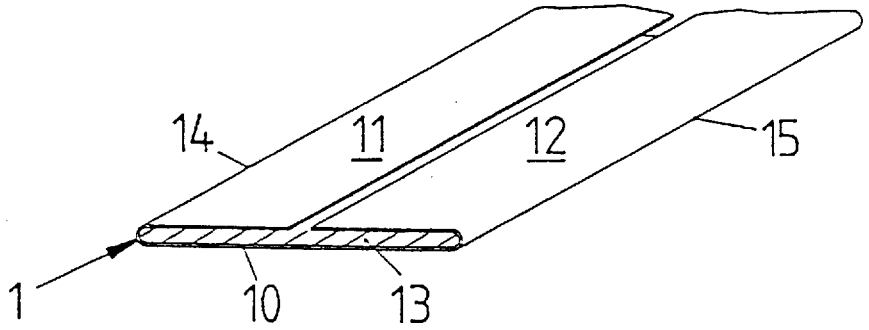
FIGS. 1–9 are partial, perspective views of different embodiments of the invention.

Referring now to the figures of the drawing in detail and first, particularly, to the first exemplary embodiment of FIG. 1, there is seen a tear strip formed of a paper strip 1 whose lateral regions 11 and 12 are folded over, above the middle region 10, onto one side such that their long edges rest tightly on one another. The plies resting on one another are glued together by means of a layer 13 of an adhesive. That tear strip, which has two plies, thus has long edges or longitudinal edges 14 and 15, formed by folds, with which the paper web is severed.

Figure 2:
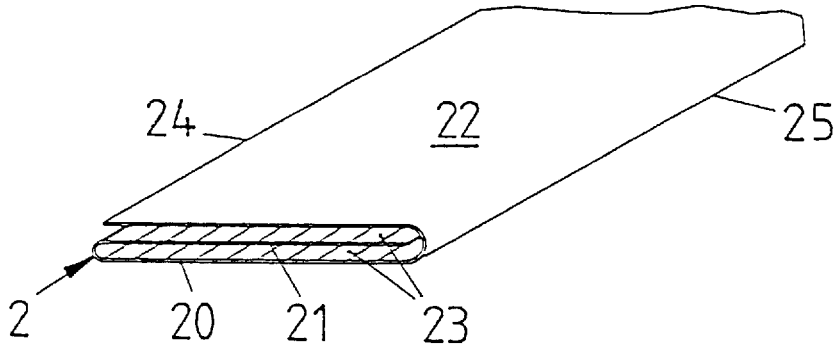

With reference to FIG. 2, a further exemplary tear strip is formed of a paper strip 2 whose lateral edges 21 and 22 are folded over one another above the middle region 20 and are glued to one another by means of adhesive layers 23. There is thus formed a three-ply tear strip, whose two side edges 24 and 25 form the severing edges. The tear strip of FIG. 2 has increased tensile strength as compared with the tear strip of FIG. 1, because it is a three-ply tear strip.

Figure 3:
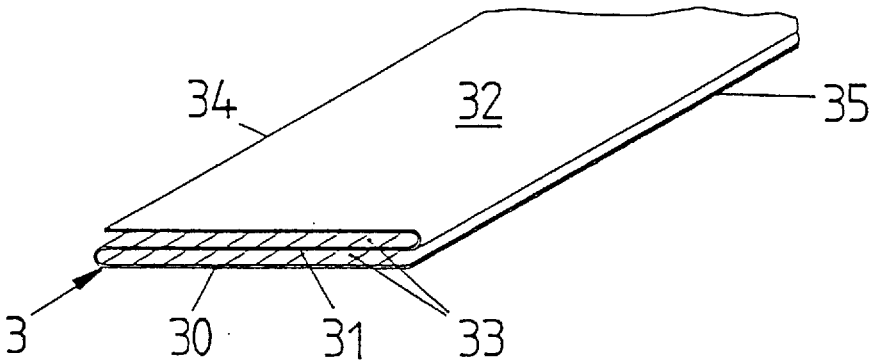

The tear strip shown in FIG. 3 differs from the tear strip shown in FIG. 2 in that the two lateral regions 31 and 32 of the paper strip 3 are folded over onto different sides of the middle region 30. This embodiment is an S-shape. Once again, the individual plies of the paper strip 3 are glued together by means of adhesive layers 33. The two side edges 34 and 35 form the severing edges.

Figure 4:
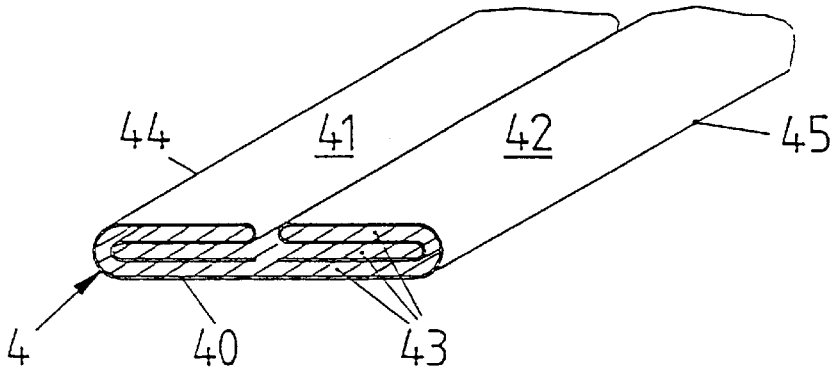

In the tear strip of FIG. 4, the two lateral regions 41 and 42 of the paper strip 4 are bent over multiple times above the middle region 40; the individual plies of the tear strip, which is four-ply in form, are joined together by means of adhesive layers 43. As a result, even higher rigidity and tearing strength are attained. The tear edges are formed by the side edges 44 and 45.

Figure 5:
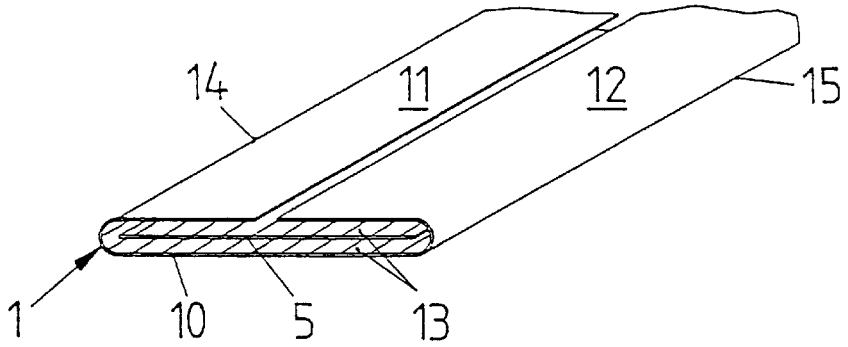

With reference to FIG. 5, the exemplary tear strip of FIG. 1 may be improved (in terms of its strength) in that a reinforcing paper strip inlay 5 is provided in the paper strip 1 whose lateral regions 11 and 12 are folded toward one another. The tear strip is reinforced with the reinforcing paper strip 5, the width of which is virtually equal to the width of the tear strip and which is joined to the plies 10, 11, and 12 of the paper strip 1 by means of two adhesive layers 13. The inlay may also be formed by a backing strip of paper, which is coated on both sides with a water-soluble adhesive, i.e. by a two-sided gummed strip, or by a backing-less adhesive tape.

Figure 6:
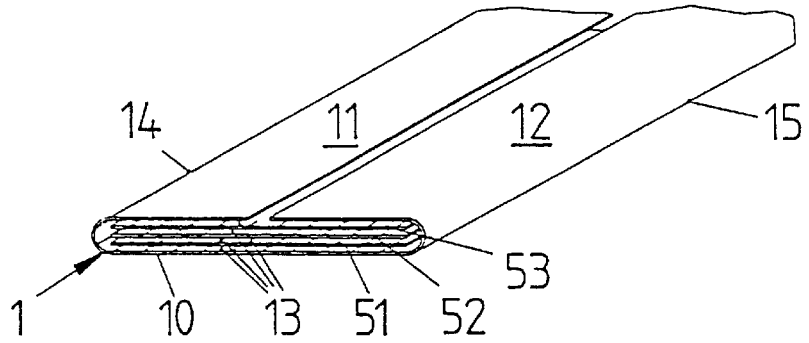

In FIG. 6, yet another tear strip is shown, which differs from the exemplary embodiment of FIG. 5 in that the paper strip 1 encloses three paper strips 51, 52, 53, located one above the other, which form a reinforcing inlay, and which are joined to the plies of the paper strip 1 by means of a plurality of adhesive layers 13.

Figure 7:
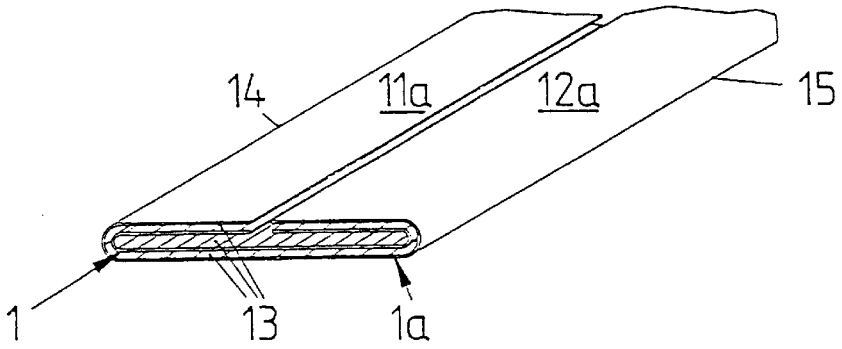

In FIG. 7, a tear strip is shown which differs from the exemplary embodiment of FIG. 1 in that two paper strips 1 and 1*a* are glued together; the lateral regions 11*a* and 12*a* of the outer paper strip 1*a* are folded over on top of the folded paper strip 1 and are glued to the other plies by means of adhesive layers 13 located on the inside.

Figure 8:
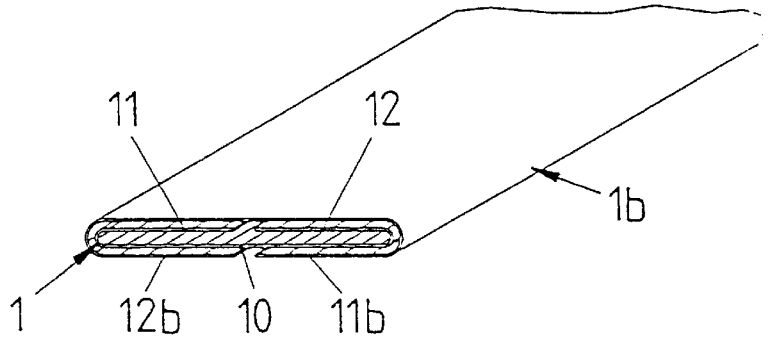

In FIG. 8, a tear strip is shown whose lateral regions 10, 11, 12 of FIG. 1 are so enclosed by a second paper strip 1*b* that the lateral regions 11, 12 and 11*b*, 12*b* of the two paper strips 1 and 1*b* are located on different sides of the tear strip.

Figure 9:
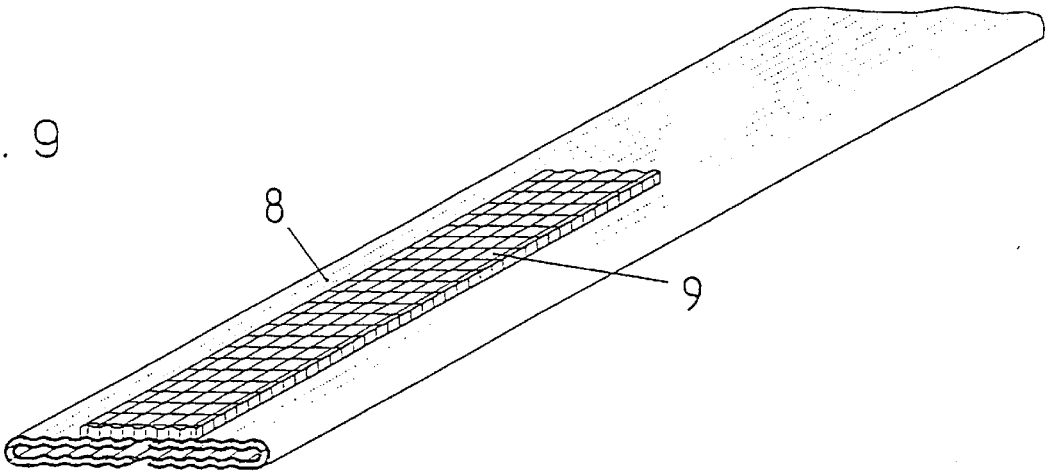

To attain the requisite flexibility of such a tear strip, the tear strip may be embodied with profile features in the form of a corrugation in the crosswise direction. In FIG. 9, a tear strip 8 as in FIG. 8 is shown, which is corrugated in the crosswise direction and onto which a generally flat adhesive layer 9, which is needed for the severing operation, is applied. Since this adhesive layer 9 adapts to the corrugated nature of the tear strip, the disadvantages of the prior are nevertheless avoided.

A tear strip of this kind, made of paper, can be made in arbitrary lengths.

More specific information concerning the general field of this invention may be found in our copending application Ser. No. 08/544,072, which is herewith incorporated by reference.

We claim:

1. A tear strip assembly for severing a moving paper web being wound onto a drum, for enabling the paper web to be wound onto an empty drum, comprising: a tear strip formed of a multiply folded paper strip, said paper strip having a plurality of plies of substantially equal width resting on one another, said plurality of plies being at least partially adhesively bonded to one another, and being made of paper material having a primarily longitudinal fiber orientation parallel to a longitudinal extent of said tear strip.

2. The assembly according to claim 1, wherein said paper strip has two lateral regions, and said lateral regions being folded over multiple times.

3. The assembly according to claim 1, wherein said paper strip has two lateral regions, said two lateral regions being folded over onto one side.

4. The assembly according to claim 1, wherein said paper strip has two lateral regions, and said two lateral regions of said paper strip are folded over onto mutually different sides.

5. The assembly according to claim 1, wherein said paper strip has two side edges, and said two side edges of said paper strip are located approximately centrally in said tear strip.

6. The assembly according to claim 1, wherein said paper strip has two lateral regions, and said two lateral regions of said paper strip are folded over onto one side, overlapping one another.

7. The assembly according to claim 6, wherein two side edges of said paper strip are located approximately at respective side edges of said tear strip.

8. The assembly according to claim 1, which further comprises an inlay paper strip disposed between at least two of said plies, said inlay paper strip being adhesively bonded to said paper strip.

9. The assembly according to claim 8, wherein said inlay paper strip is a multi-ply paper strip.

10. The assembly according to claim 9, wherein said multi-ply paper strip is a folded paper strip.

11. The assembly according to claim 8, wherein said inlay is gummed on both flat sides thereof.

12. The assembly according to claim 1, which further comprises an adhesive layer strip disposed between at least two of said plies.

13. The assembly according to claim 1, wherein said adhesive is water-soluble.

14. The assembly according to claim 1, wherein said tear strip is formed with longitudinally extending grooves.

15. The assembly according to claim 1, wherein said tear strip is corrugated in a transverse direction thereof.

* * * * *